US005816144A

United States Patent [19]

Schandl et al.

[11] Patent Number: 5,816,144

[45] Date of Patent: Oct. 6, 1998

[54] PRECISION ROLL STAND

[75] Inventors: Ernst Schandl, Linz; Ernst Pokorny, Traun, both of Austria

[73] Assignee: Voest-Alpine Industrieanlagenbau GmbH, Linz, Austria

[21] Appl. No.: 722,641

[22] Filed: Sep. 27, 1996

[30] Foreign Application Priority Data

Sep. 28, 1995 [AT] Austria ..... 1608/95

[51] Int. Cl.[6] ..... B30B 3/04

[52] U.S. Cl. ..... 100/47; 72/9.2; 72/238; 72/245; 72/249; 100/155 R; 100/170; 100/172

[58] Field of Search ..... 100/47, 155 R, 100/161, 170, 172, 176; 72/238, 239, 245, 249, 9.2, 11.8, 12.7, 12.8, 16.9

[56] References Cited

U.S. PATENT DOCUMENTS

| | | | |
|---|---|---|---|
| 3,016,772 | 1/1962 | Hornbostel | 72/249 |
| 3,244,090 | 4/1966 | Bischoff | 100/170 |
| 3,336,781 | 8/1967 | Wilson et al. | 72/238 |
| 3,945,234 | 3/1976 | Steinbock | 72/238 |
| 4,030,332 | 6/1977 | Koch et al. | 72/238 |
| 4,205,596 | 6/1980 | Chesnut | 100/170 |
| 4,357,171 | 11/1982 | Nurse | 100/170 |
| 4,428,054 | 1/1984 | Aizawa et al. . | |
| 4,478,065 | 10/1984 | Gancia et al. | 72/239 |
| 4,580,429 | 4/1986 | Gilvar . | |
| 4,949,568 | 8/1990 | Poloni | 72/249 |
| 5,095,728 | 3/1992 | Poloni | 72/239 |
| 5,305,624 | 4/1994 | Backhaus . | |

FOREIGN PATENT DOCUMENTS

| | | | |
|---|---|---|---|
| 370 643 | 4/1983 | Austria . | |
| 390 741 | 6/1990 | Austria . | |
| 0 515 005 | 11/1992 | European Pat. Off. . | |
| 970102 | 8/1958 | Germany | 72/249 |
| 1 110 115 | 1/1962 | Germany . | |
| 32 14 411 | 12/1982 | Germany . | |
| 255170 | 10/1969 | U.S.S.R. | 72/249 |
| 1 485 091 | 9/1977 | United Kingdom . | |

*Primary Examiner*—Stephen F. Gerrity
*Attorney, Agent, or Firm*—Hill, Steadman & Simpson

[57] ABSTRACT

A precision roll stand includes a roll housing absorbing the rolling forces. In the roll housing rolls constituting a roll pair with their roll chocks are mounted so as to be rotatable and mutually adjustable by an adjustment device which changes the axial distance between the pair of rolls. A drive housing including a roll drive is connectable with the roll housing while establishing a drive connection of the roll drive with the rolls and being removable from the same while undoing the drive connection. In order to produce rolled products exhibiting extremely high measuring accuracies and to be able to exchange the rolls quickly and without difficulty, the roll housing has a frame which is open in the direction of adjustment of the rolls and contains and guides the chocks of the rolls. A crosshead for closing the frame carries the adjustment device designed as a pressure medium cylinder and is rigidly connectable with the frame. The drive housing is supported on the crosshead.

9 Claims, 2 Drawing Sheets

PRECISION ROLL STAND

BACKGROUND OF THE INVENTION

The invention relates to a precision roll stand comprising a roll housing absorbing the rolling forces and in which rolls constituting a roll pair, in particular grooved rolls, with their roll chocks are mounted so as to be rotatable and mutually adjustable by an adjustment means while changing their axial distance, and a drive housing including a roll drive, the drive housing being connectable with the roll housing while establishing a drive connection of the roll drive with the rolls and removable from the same while undoing said drive connection.

As a rule, at least two precision roll stands—in the technical literature also referred to as sizing roll stands—are consecutively arranged in series either so as to be inclined at an angle of 45° relative to the horizontal plane with one stand oriented in one direction and the other stand oriented in the opposite direction, or in an alternately horizontal-vertical manner, adjacent precision roll stands coming to lie so as to be inclined relative to each other by 90°. Preferably, the grooved rolls are mutually adjustable under load such that deviations of the dimensions of the rolled product from the ideal dimensions may be corrected during rolling.

A precision roll stand of the initially defined kind is known, for instance, from AT-B-370643. In order to adjust one of the grooved rolls, this grooved roll in that known precision roll stand is inserted in eccentric bearing bushes with its bearings. The bearing bushes are rotatably inserted in the roll housing in a manner that the roll pass, or axial distance of the two grooved rolls, may be changed by turning the bearing bushes.

From EP-A-0 515 005 it is known to reach narrow tolerances for the rolling stock in that, from a plurality of precision roll stands, the precision roll stands exclusive of the precision roll stand arranged last in the rolling direction comprise grooved rolls that are adjustable under load. The final precision roll stand has a fixed pass, which is supposed to ensure a precise sectional shape of the rolling stock. The geometric data of the rolled product are detected in front of the next to the last roll stand and used to adjust the optimum pass of the next to the last precision roll stand. Thereby, errors in the thickness due to tension control as well as measuring deviations caused by temperature faults in the operation of a furnace may be compensated for.

However, in that case it is disadvantageous that, if deviations of the dimensions of the rolled product nevertheless occur upon emergence from the final precision roll stand, for instance due to wear, correction is no longer possible. It would be conceivable to provide as the final precision roll stand a roll stand as is described in AT-B-370643 such that corrections may be carried out on the rolling stock even at the final roll stand, yet difficulties would arise because the adjustment means for adjusting the roll pass known from AT-B-370643 does not allow quick adjustment. In particular, with a rapidly running mill train, such as a rod or wire train, relatively long pieces of material being rolled that have dimensions deviating from the ideal dimension would result. Moreover, several disturbing factors in total might result in dimensional deviations that are too large unless counteracted immediately.

SUMMARY OF THE INVENTION

The invention aims at avoiding these disadvantages and difficulties and has as its object to provide a precision roll stand of the initially defined kind, which enables the quick adjustment of the roll pass such that rolled products exhibiting extremely high dimensional accuracies can be produced. In particular, it is to be feasible to correct deviations immediately upon their appearance such that deviations of, for instance, ±0.1 mm, based on a diameter of the rolled product of approximately 16 mm, may be guaranteed. In addition, the invention has as its object to allow the rolls of the precision roll stand to be replaced in a quick and uncomplicated manner in order to be able to employ the precision roll stand for different rolling stock. In particular, the production of rolling stock in which high rolling forces are required is to be feasible, too.

In accordance with the invention, this object is achieved in that the roll housing comprises a frame open in the direction of adjustment of the rolls and containing and guiding the chocks of the rolls, and a crosshead closing the frame, that the crosshead carries the adjustment means designed as a pressure medium cylinder, that the crosshead is rigidly connectable with the frame and that the drive housing is supported on the crosshead.

The arrangement according to the invention, of the pressure medium cylinders in the base portion not only renders feasible the quick adjustment of the roll pass, but also offers a very simple and rapidly feasible exchangeability of the rolls, the latter being removable from the precision roll stand together with the frame carrying them. Within the mill train there will remain the crosshead of the roll housing along with the drive housing as well as the roll drive and the adjustment means such that setting operations need be carried out neither at the frame exchanged together with the rolls nor at the gauge adjustment.

Suitably, the drive housing is rigidly connectable with the crosshead.

A particularly quick exchange of the rolls is feasible if the crosshead is connectable with the frame by means of a quick gripping device.

In that case, the quick gripping device advantageously is comprised of tension rods adjustably arranged on the crosshead and insertable in groove-like recesses of the frame.

A simple and cost-effective structure is characterized in that one of the rolls is supported in a chock receiving both bearings of this roll, that the chock is displaceably guided within the frame and that the chock rests on the pressure medium cylinders in the assembled state of the precision roll stand.

A sturdy structure ensuring a high accuracy of the rolled product even at high rolling forces is characterized in that the frame is U-shaped so as to embrace the chocks of both rolls and the crosshead is designed as a part interconnecting the two legs of the U.

With a view to simple handling, the frame advantageously is pivotably supported on the drive housing on its end facing away from the crosshead.

Preferably, the precision roll stand is characterized by an automatic gauge control system acting on the adjustment means for adjusting the axial distance of the rolls constituting a roll pair.

In the following the invention will be explained in more detail by way of an exemplary embodiment with reference to the accompanying drawings.

DESCRIPTION OF THE PREFERRED EMBODIMENTS

Figure 1:
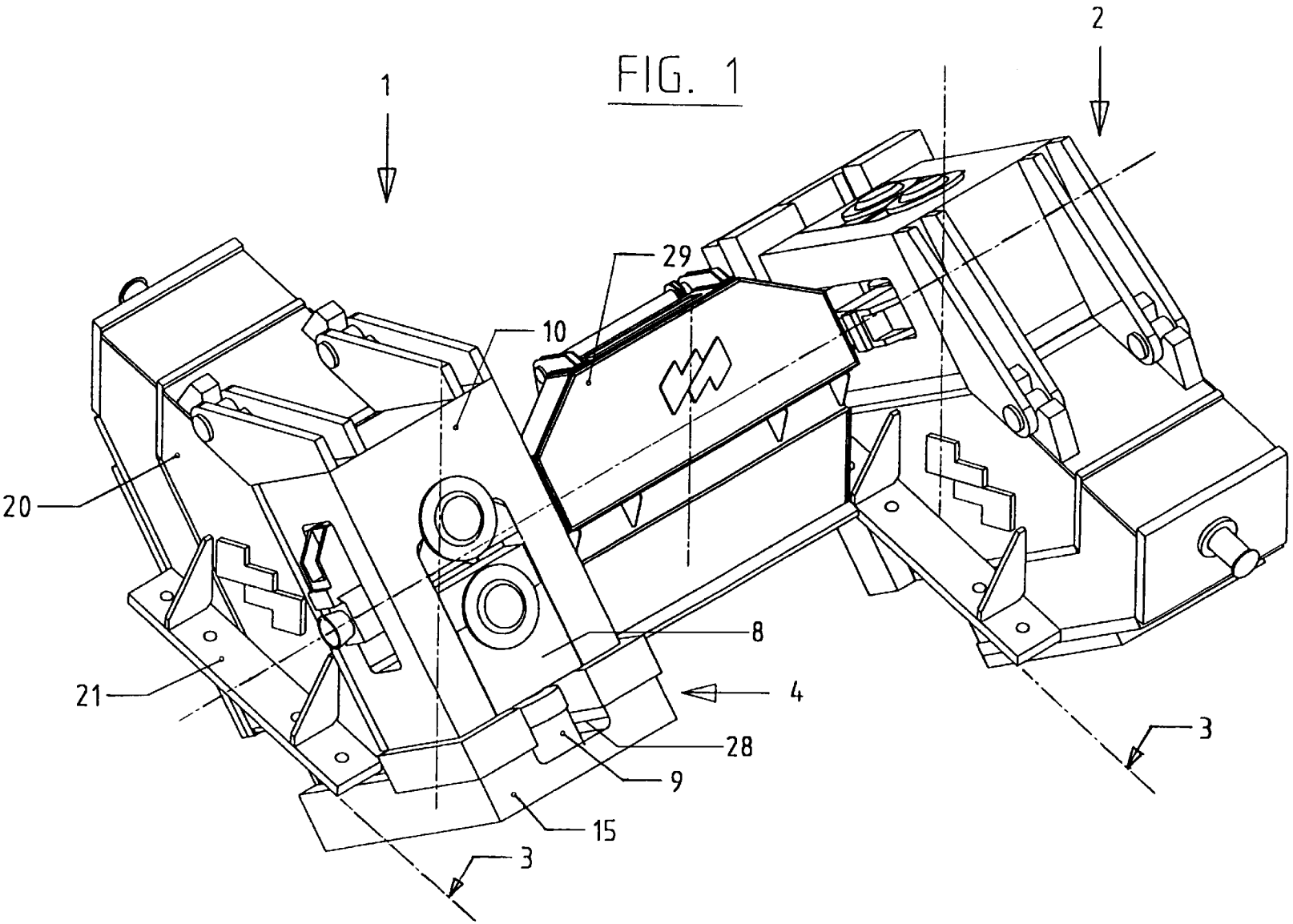
FIG. 1 is an oblique view of part of a rolling mill train comprising two precision roll stands consecutively arranged in the rolling direction.

FIG. 1 shows two precision roll stands 1, 2 consecutively arranged in the rolling direction, of a train for rods or bars, which as a whole is comprised of several rolling units, such as a blooming train, an intermediate train, a finishing train and a precision roll stand block. The two precision roll stands 1, 2 from the precision roll stand block of this train for rods or bars. The number of precision roll stands of the precision roll stand block depends on the set demands, and it is also possible to arrange more than two precision roll stands one after the other.

The two precision roll stands 1, 2 are arranged at an angle of 45° relative to the horizontal line 3, with one stand in towards one side-and the other stand inclined towards the other side so as to enclose an angle of 90°.

Each of the two identically designed, yet side-invertedly arranged precision roll stands comprises a roll housing 4, in which grooved rolls 5, 6 (see FIG. 3) constituting a roll pair are rotatably mounted with their chocks 7, 8. The rolling forces are absorbed by the roll housing 4. (see FIG. 1) One grooved roll 5 of the grooved rolls 5, 6 is rotatably mounted within the roll housing 4 in a rigid, i.e., non-displaceable manner, whereas the second grooved roll 6 for the purpose of changing the axial distance of the two grooved rolls 5, 6 is mounted so as to be adjustable by aid of an adjustment means 9. A change of the axial distance and hence of the roll pass may be effected during the rolling procedure.

Figure 3:
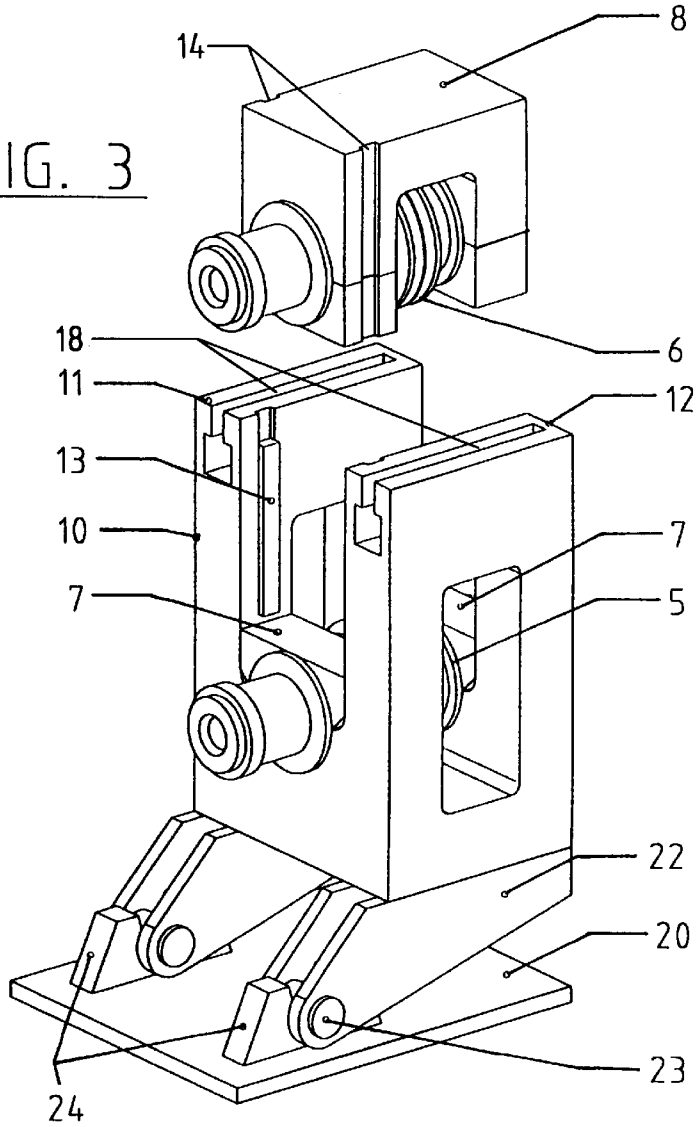
FIG. 3 is an exploded oblique view of a frame including groove rolls.

As is apparent in particular from FIG. 3, the roll housing comprises a frame 10, in which both of the grooved rolls 5, 6 are mounted, the adjustable grooved roll 6 also being guided therein. The frame 10 is U-shaped. The two legs 11, 12 of the U-shaped frame 10 serve as guide means for the adjustable grooved roll 6, i.e., its chock 8, in which the grooved roll 6 is rotatably journalled by its two bearings. Guide ledges 13, which are inserted in the legs 11, 12 of the U and are engaged in corresponding guide recesses 14 of the chocks 8, serve to secure the position of the grooved roll 6 in the sense of its axis.

In addition, the roll housing 4 comprises a crosshead 15 for closing the frame 10 and for rigidly interlocking the two free ends of the two legs 11, 12 of the U. In order to ensure a safe connection, tension rods 16 are adjustably mounted in the crosshead 15, which, by their heads 17, engage in corresponding groove-shaped recesses 18 provided on the end faces of the free ends of the legs 11, 12 of the U. By adjusting the tension rods 16, the crosshead 15 may be fixed to the frame 10 by clamping. The tension rods together with their actuation means, which, for instance, may be pressure medium cylinders 19, constitute a quick gripping device enabling the frame 10 to be quickly and readily detached from the crosshead 15 and, on the other hand, the two parts 10 and 15 to be quickly fixed to each other.

A drive housing 20 comprising the roll drive is rigidly fastened to the crosshead 15. This drive housing 20 carries supporting consoles 21 for supporting the entire precision roll stand 1 and 2, respectively, relative to the foundation.

Figure 2:
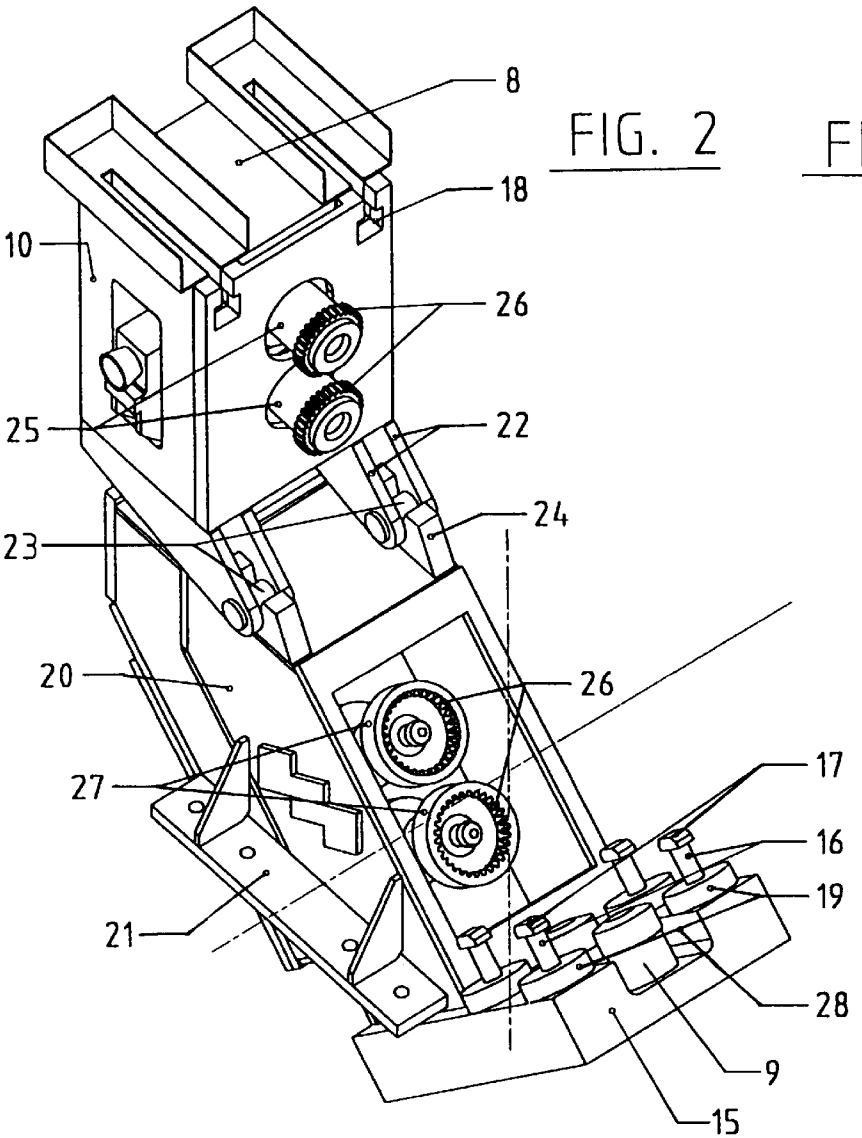
FIG. 2 is a detailed oblique view of a roll stand of FIG. 1, with the frame pivoted upwards.

As is apparent, in particular from FIG. 2, the frame 10, on its end facing away from the crosshead 15, i.e., at the base of the U, is pivotably mounted on the drive housing 20 via supporting brackets 22 which are arranged on the frame 10 and carry pins 23, which, in turn, are mounted in upwardly open bearing pockets 24 provided on the external side of the drive housing 20.

The roll pins or shafts 25 of the grooved rolls 5, 6, which are each connectable with the drive pins or shafts 27 of the roll drive by means of a coupling 26, project from the frame 10. In accordance with the invention, this coupling is designed as a denture coupling. The connection may be established automatically by pivoting the frame 10 into the installed position represented in FIG. 1, the heads 17 of the tension rods thereby sliding into the respective grooves 18 of the frame 10. Connection elements for coolant to be supplied to the grooved rolls 5, 6 likewise may automatically be connected in a manner known per se to stationary ducts during pivoting of the frame 10 into and out of the installed position, for instance, by means of plug connections, etc.

The pressure medium cylinders constituting the adjustment means 9 are provided on the crosshead 15 in a depression 28. These pressure medium cylinders 9 directly engage the chock 8 of the adjustable grooved roll 6 as soon as the frame 10 has been pivoted into the installed position. By arranging the pressure medium cylinders 9 on the crosshead 15, which remains stationary during the exchange of the rolls, it is no longer necessary to disconnect and reconnect, respectively, pressure medium ducts leading to the pressure medium cylinders 9 during an exchange of the grooved rolls 5, 6.

A guiding means 29 for guiding the rolling stock, which for instance may be equipped with a gauge measuring device, is arranged between the two precision roll stands 1, 2.

The pressure medium cylinders 9, which are designed as hydraulic cylinders, are operated via an automatic gauge control system in order to compensate for, i.e., eliminate, dimensional deviations of the rolled product from the ideal measure immediately upon detecting such dimensional deviations. Gauge control systems of this type are known in various configurations. For instance, the system referred to as "AGC" system (automatic gauge control system) as described, for instance, in U.S. Pat. No. 4,428,054 is particularly suitable.

What we claim is:

1. In a precision roll stand of the type including a roll housing adapted to absorb the rolling forces generated during rolling, first and second rolls constituting a roll pair and contained in pertaining roll chocks, said first and second rolls being rotatably received in said roll housing with said pertaining roll chocks, an adjustment means adapted to mutually adjust said first and second rolls while changing their axial distance, and a drive housing containing a roll drive, said drive housing being connectable with said roll housing while establishing a drive connection of said roll drive with said first and second rolls and removable from said roll housing while undoing said drive connection, the improvement wherein said roll housing comprises a frame open in the direction of adjustment of said rolls and a crosshead closing said frame, said frame being adapted to contain and guide said roll chocks, said adjustment means is designed as a pressure medium cylinder means supported on said crosshead, said crosshead is capable of being rigidly connected with said frame, and said drive housing is supported on said crosshead.

2. A precision roll stand as set forth in claim 1, wherein said drive housing is capable of being rigidly connected with said crosshead.

3. A precision roll stand as set forth in claim 1, further comprising a quick gripping means adapted to connect said crosshead with said frame.

4. A precision roll stand as set forth in claim 3, wherein said quick gripping means is comprised of tension rod means adjustably arranged on said crosshead and said frame has groove-like recess means adapted to receive said tension rod means.

5. A precision roll stand as set forth in claim 1, wherein one of said first and second rolls is supported in a respective one of said roll chocks receiving both bearings of said one roll, said respective one of said roll chocks being displaceably guided within said frame and, in the assembled state of said precision roll stand, resting on said pressure medium cylinder means.

6. A precision roll stand as set forth in claim 1, wherein said frame is shaped in the manner of a U having two legs embracing said roll chocks of both of said first and second rolls and said crosshead is formed as a part interconnecting said two legs of said U.

7. A precision roll stand as set forth in claim 1, wherein said frame, on its end facing away from said crosshead, is pivotably supported on said drive housing.

8. A precision roll stand as set forth in claim 1, further comprising an automatic gauge control system adapted to act on said adjustment means with a view to adjusting the axial distance of said first and second rolls constituting a roll pair.

9. A precision roll stand as set forth in claim 1, wherein said rolls are grooved rolls.

* * * * *